US011311817B1

(12) United States Patent
Nam et al.

(10) Patent No.: US 11,311,817 B1
(45) Date of Patent: Apr. 26, 2022

(54) MODULAR TOY ASSEMBLY SYSTEM

(71) Applicant: Strottman International, Inc., Irvine, CA (US)

(72) Inventors: Peter Nam, Irvine, CA (US); John Martin, El Segundo, CA (US)

(73) Assignee: Strottman International, Inc., Irvine, CA (US)

( * ) Notice: Subject to any disclaimer, the term of this patent is extended or adjusted under 35 U.S.C. 154(b) by 12 days.

(21) Appl. No.: 16/907,170

(22) Filed: Jun. 20, 2020

(51) Int. Cl.
*A63H 33/10* (2006.01)
*A63H 33/08* (2006.01)

(52) U.S. Cl.
CPC ..... *A63H 33/105* (2013.01); *A63H 33/086* (2013.01)

(58) Field of Classification Search
CPC .... A63H 33/08; A63H 33/084; A63H 33/086; A63H 33/10; A63H 33/105
USPC ..... 446/85, 105, 108, 111, 120, 124, 126, 446/128
See application file for complete search history.

(56) References Cited

U.S. PATENT DOCUMENTS 4,334,868 A * 6/1982 Levinrad ..... A63F 9/0098 434/172
4,571,200 A * 2/1986 Serna ..... A63H 33/105 446/111
5,199,919 A * 4/1993 Glickman ..... A63H 33/062 446/120
5,350,331 A * 9/1994 Glickman ..... A63H 33/042 446/120
5,470,139 A * 11/1995 Hsiao ..... A47B 47/005 312/111
5,647,181 A * 7/1997 Hunts ..... A63H 33/10 312/111
5,788,555 A * 8/1998 Glynn ..... A63H 33/10 446/124
6,004,182 A * 12/1999 Pasin ..... A63H 33/10 135/119
6,015,149 A * 1/2000 Burk ..... A63F 1/04 273/148 A
6,231,416 B1 * 5/2001 Clever ..... A63H 33/082 446/108
6,558,222 B1 * 5/2003 Maddock ..... A63H 33/105 446/105
6,634,920 B1 * 10/2003 Michaelsen ..... A63H 33/04 446/128
6,645,032 B2 * 11/2003 Barringer ..... A63H 33/10 446/108

(Continued)

*Primary Examiner* — Alexander R Niconovich
(74) *Attorney, Agent, or Firm* — Rutan & Tucker, LLP

(57) ABSTRACT

According to one embodiment, a modular toy assembly system featuring one or more bases and a plurality of posts. Coupled to recessed connectors of the base, the plurality of posts includes a first end connector and a second end connector for coupling to different bases to provide depth of the toy. The posts include a first elongated body element and a second elongated body element interposed and extending between the first end connector and the second end connector. The first elongated body element and the second elongated body element are oriented to produce (i) a first slot between a first side of first elongated body element and a first side of the second elongated body element and (ii) a second slot between a second side of first elongated body element and a second side of the second elongated body element.

18 Claims, 11 Drawing Sheets

(56) References Cited

U.S. PATENT DOCUMENTS

| | | | | |
|---|---|---|---|---|
| 6,672,931 | B1 * | 1/2004 | Bagley | A63H 33/08 446/106 |
| 6,899,588 | B1 * | 5/2005 | Clever | A63H 33/084 446/120 |
| 7,198,537 | B1 * | 4/2007 | Clever | A63H 33/084 446/120 |
| 7,267,598 | B2 * | 9/2007 | Glickman | A63H 33/101 446/124 |
| 8,070,551 | B1 * | 12/2011 | Clever | A63H 33/088 446/124 |
| 8,550,867 | B1 * | 10/2013 | Clever | A63H 33/088 446/124 |
| 9,879,413 | B2 * | 1/2018 | Castelli | E04B 1/1903 |
| 9,919,235 | B2 * | 3/2018 | Kislevitz | A63H 33/105 |
| 2005/0160652 | A1 * | 7/2005 | Moody | A63H 33/086 40/741 |
| 2006/0025035 | A1 * | 2/2006 | Glickman | A63H 33/102 446/124 |
| 2006/0046604 | A1 * | 3/2006 | Scarborough | A63H 33/062 446/108 |
| 2007/0060010 | A1 * | 3/2007 | Richdale | A63H 33/086 446/85 |
| 2008/0090485 | A1 * | 4/2008 | Glickman | A63H 33/086 446/120 |

* cited by examiner

FIG. 3A
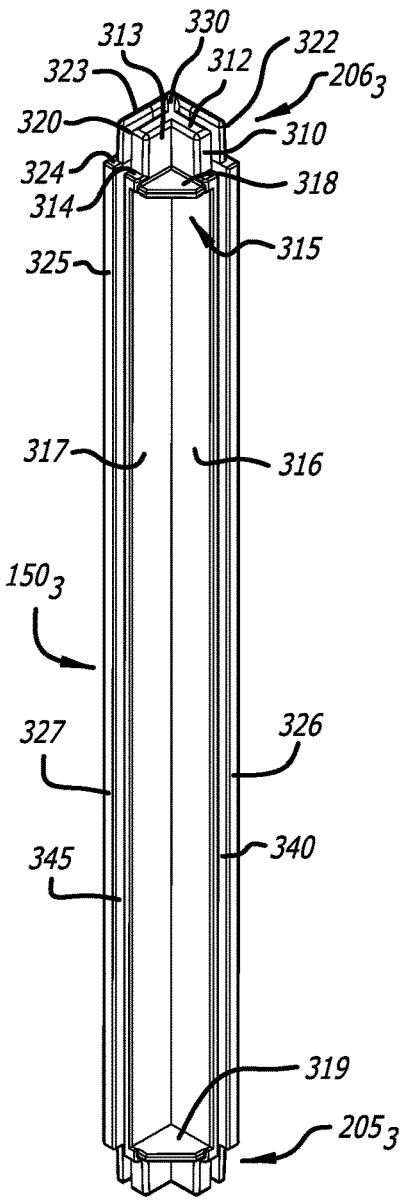
FIG. 4A
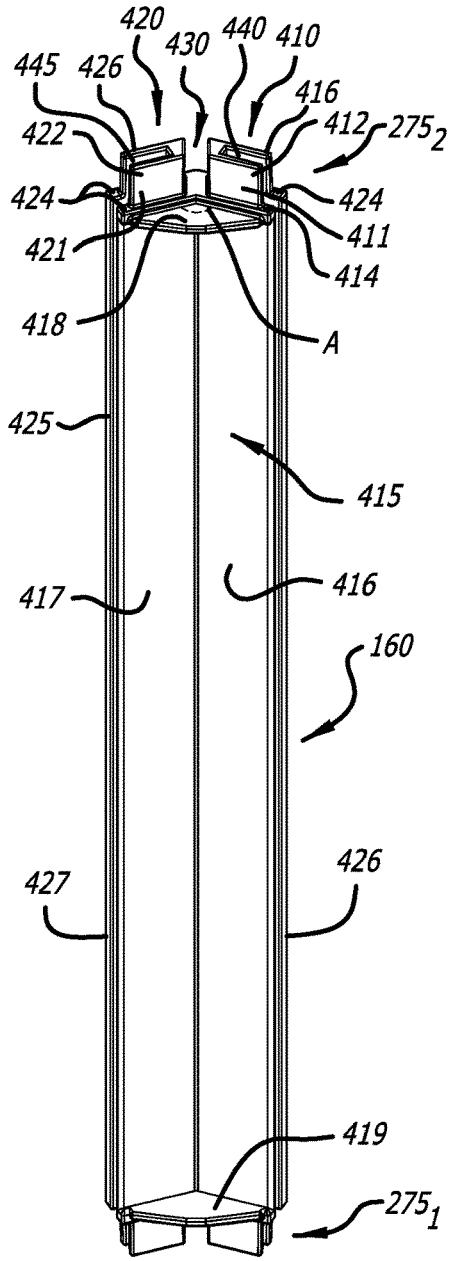
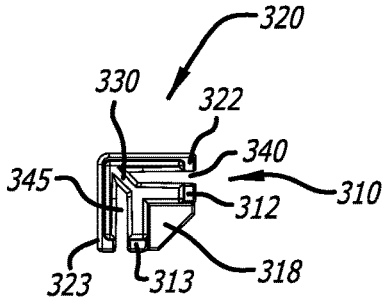
FIG. 3B
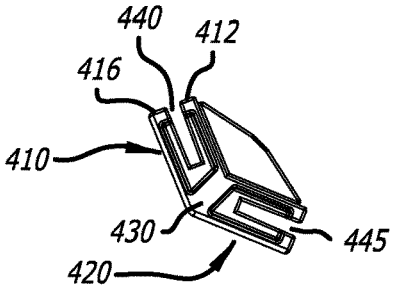
FIG. 4B

MODULAR TOY ASSEMBLY SYSTEM

1. FIELD

Embodiments of the disclosure relate to the field of toys. More specifically, one embodiment of the disclosure relates to a modular toy assembly system that includes a selected arrangement of components to allows a person to design and build various toy frameworks.

2. GENERAL BACKGROUND

For decades, toy construction sets have allowed a person to construct various imaginary items, such as a rocket, a spaceship, a house, a sled, a bridge, or the like. These toy construction sets are modular to allow for design flexibility. For instance, one of the oldest and most popular toy construction sets has been the "Erector" set, which includes modular components such as a series of plates and bars with holes in them that can be joined together with nuts and bolts. Over time, other toy construction sets were developed in which these modular components included integrated connection mechanisms. As an illustrative example, LEGO® toy construction sets are adapted with LEGO® pieces of different sizes, where each of the LEGO® pieces includes a top connection side featuring multiple cylindrical protrusions and a bottom connection side featuring recesses complementary to these cylindrical protrusions for retention of one or more other LEGO® pieces.

Although Erector and LEGO® sets are design to help children understand spatial relationships and learn general construction principles, these toy construction sets lack a certain degree of creative input in customizing and building a resultant toy. For example, each of these toy construction sets is designed to create a support infrastructure for the resultant toy, namely the framework formed by an interconnection of components. However, while conventional toy construction sets enable the user to design the toy's framework, these toy construction sets fail to support further creativity in providing features that allow a child to personally customize each constructed toy.

BRIEF DESCRIPTION OF THE DRAWINGS

Embodiments of the invention are illustrated by way of example and not by way of limitation in the figures of the accompanying drawings, in which like references indicate similar elements and in which:

FIG. 3A is a perspective view of an exemplary embodiment of a right-angled post of the toy assembly system of FIGS. 1-2.

FIG. 3B is a top or bottom plan view of a connector for the right-angled post of FIG. 3A.

FIG. 4A is a perspective view of an exemplary embodiment of a obtuse-angled post of the toy assembly system of FIGS. 1-2.

FIG. 4B is a top or bottom plan view of a connector for the obtuse-angled post of FIG. 4A.

DETAILED DESCRIPTION

Figure 1:
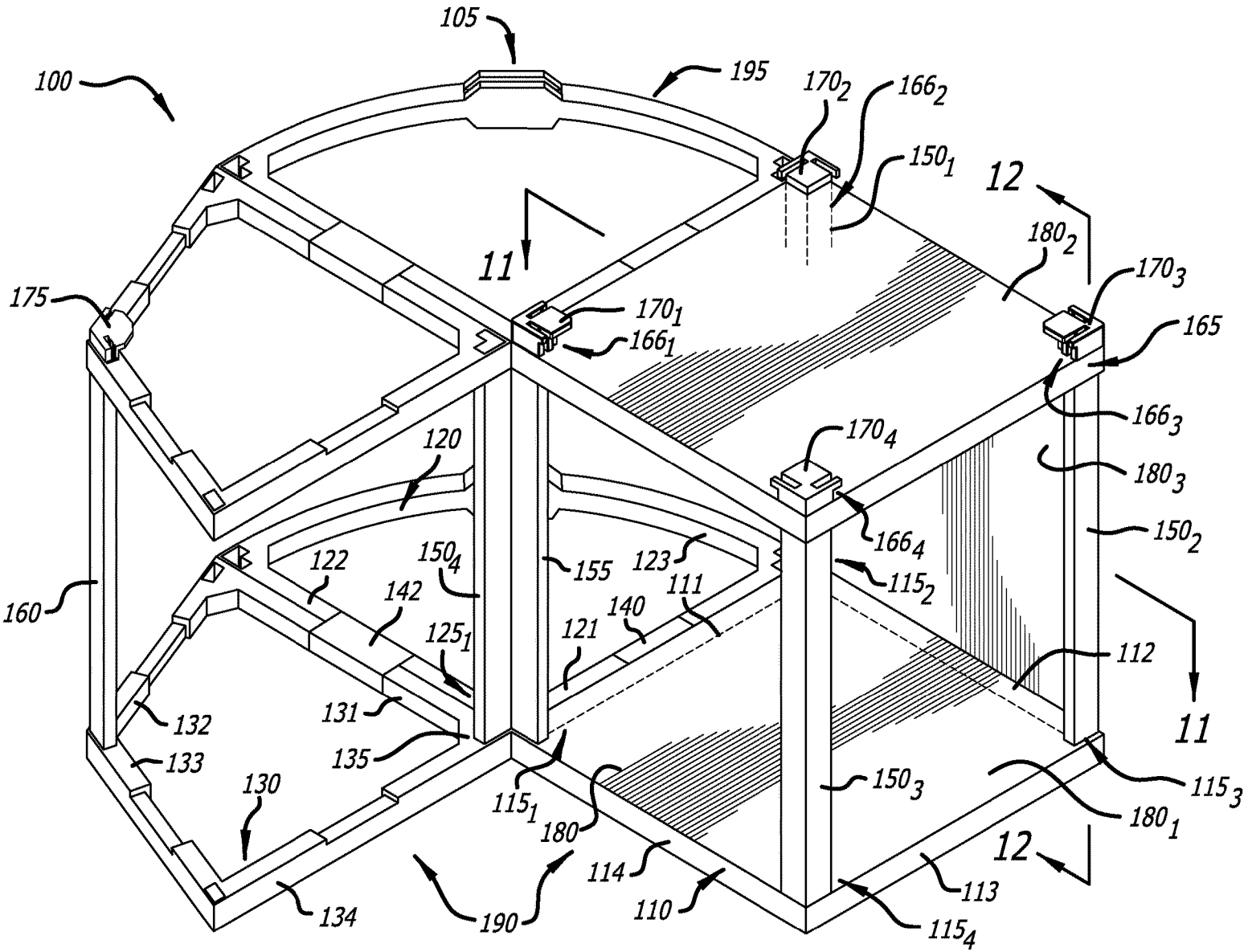
FIG. 1 is a perspective view of an exemplary embodiment of a modular, toy assembly system according to one embodiment of the disclosure.

Various embodiments of the disclosure relate to a modular toy assembly system including removable components that, when coupled together, collectively form a toy framework (e.g., the underlying structure for a resultant toy). The type of toy framework may depend on the selected combination of components, which may include, but is not limited or restricted to a particular combination of bases (e.g., square, round, octagon, etc.), base fasteners, posts (e.g., right-angled posts, obtuse-angled posts, straight-angled posts, etc.), and caps (e.g., right-angled caps, obtuse-angled caps, etc.).

According to one embodiment of the disclosure, a single base or multiple bases coupled together using one or more base fasteners may be used to form a first planar section of the toy framework. The first planar section may be arranged horizontally (e.g., as a base or another level of the toy framework), vertically (e.g., as a sidewall of the toy framework), or in another type of orientation (e.g., diagonal, etc.). When partially inserted into recessed connectors formed in selected areas of the first planar section, posts may be used to create separation between the first planar section and at least a second planar section. The second planar section may feature one or more bases that at least partially (and perhaps completely) overlay the first planar section in order to expand the length, width and/or depth (height) of the toy framework. The caps may be used to cover these recessed connectors within a base (or multiple bases) forming the second planar section. For this example, the cap includes a protruding end connector that occupies a first portion of a recessed connector of a base associated with the second planar section while a protruding end connector of a post occupies a second portion of the recessed connector. Each of the posts and caps, including their protruding connectors, may include one or more slots for receipt and retention of a covering (e.g., sheet of paper, plastic, etc.) which, when installed, provides a surface (e.g., outer "skin") for the toy framework.

I. Terminology

In the following description, certain terminology is used to describe features of the invention. For example, in certain situations, the term "component" is representative of a physical structure for use in construction of a toy framework. The component may be constructed with any type of rigid or semi-rigid material including, but not limited or restricted to, a polymer (e.g., polyethylene, polypropylene, poly vinyl chloride, acrylonitrile butadiene styrene, etc.), a metal, an organic material (e.g., wood, etc.), or the like. Herein, an "element" may be construed as a portion of a component, such as a portion of the "base" component for example.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions.

Also, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure is to be considered as an example of the principles of the invention and not intended to limit the invention to the specific embodiments shown and described.

II. Modular System Architecture

Referring to FIG. 1, a perspective view of an exemplary embodiment of a modular, toy assembly system 100 is shown. The toy assembly system 100 features multiple types of base structures that partially form a framework 105 for a resultant toy. Types of different base structures may include, but is not limited or restricted to, a square base 110, a round base 120, and an octagon base 130. As shown, according to one embodiment of the disclosure, all of these bases 110, 120 and 130 may be positioned to collectively form a first planar area 190. Herein, for this illustrative embodiment, the square base 110 and round base 120 may be oriented so that a first perimeter edge element 111 of the square base 110 is positioned adjacent to a first perimeter edge element 121 of the round base 120. Also, a second perimeter edge element 122 of the round base 120 is positioned adjacent to a first perimeter edge element 131 of the octagon base 130.

For securing bases 110, 120 and 130 to form the first planar area 190, the first perimeter edge element 111 of the square base 110 is secured to the first perimeter edge element 121 of the round base 120 by a first base fastener 140. The first base fastener 140 includes a pair of sidewalls to form a channel, where each edge of the sidewalls may include rails (protrusions extending inwardly from the sidewall into the channel) to further secure the first base fastener 140 to perimeter edge elements 111-114. The spacing between the sidewalls is sized with a width to securely maintain the first perimeter edge element 111 in parallel with the first perimeter edge element 121 of the round base 120. Additionally, the second perimeter edge element 122 of the round base 120 is secured to the first perimeter edge element 131 of the octagon base 130 by a second base fastener 142. With a similar construction as the first base fastener 140, the second base fastener 142 includes a pair of sidewalls to form a channel sized with a width to securely maintain the second perimeter edge element 122 in parallel with the first perimeter edge element 131 of the octagon base 130.

As further shown in FIG. 1, the square base 110 features the first perimeter edge element 111 along with a second perimeter edge element 112, a third perimeter edge element 113 and a fourth perimeter edge element 114. These perimeter edge elements 111-114 collectively form a perimeter of the square base 110, where certain perimeter edge elements for each of the bases 110, 120 and 130 include a cut-out region having a different (and lesser) depth at a middle section (hereinafter, "mid-section"). The different depth is selected at the mid-section in order to receive a base fastener and, upon installation of the base fastener, a top surface of the base fastener is co-planar to top surfaces of neighboring sections of the joined perimeter edge elements as illustrated by the second base fastener 142.

Also, as shown, each perimeter edge element 111-114 is coupled to at least two neighboring perimeter edge elements. For instance, a first end of the first perimeter edge element 111 is coupled at the second perimeter edge element 112 while a second end of the first perimeter edge element 111 is coupled to the fourth perimeter edge element 114. In a similar construction, the second perimeter edge element 112 is coupled to the first perimeter edge element 111 and the third perimeter edge element 113; the third perimeter edge element 113 is coupled to the second perimeter edge element 112 and the fourth perimeter edge element 114; and the fourth perimeter edge element 111 is coupled to the first perimeter edge element 111 and the third perimeter edge element 113 As shown in more detail in FIG. 2 below, recessed connectors are formed within interception (corner) areas $\mathbf{115_1}$-$\mathbf{115_4}$ of the square base 110 (e.g., areas neighboring intersecting perimeter edge elements 111&114, 111&112, 112&113 and 113&114).

For example, as shown in FIG. 1, each of the right-angled posts and/or straight-angled posts (e.g., post $\mathbf{150_1}$-$\mathbf{150_3}$ and 155) may include end connectors sized for insertion into recessed connectors of both the square base 110 and/or another base (e.g., a second square base 165) at least partially positioned directly above the square base 110.

In particular, for this illustrative embodiment, a first right-angled post $\mathbf{150_1}$ may be secured at the second intersection areas $\mathbf{115_2}$ of the square base 110 and at a second intersection area $\mathbf{166_2}$ of the second square base 165. Similarly, other right-angled posts $\mathbf{150_2}$-$\mathbf{150_3}$ may be secured at both intersection areas $\mathbf{115_3}$-$\mathbf{115_4}$ of the square base 110 and intersection areas $\mathbf{166_3}$-$\mathbf{166_4}$ of the second square base 165. A straight-angled post 155, which may be a culmination of two right-angled posts aligned together, may be partially secured at the first intersection area $\mathbf{115_1}$ of the square base 110 and a first intersection area $\mathbf{166_1}$ of the second square base 165. As shown, the straight-angled post 155 may be partially secured at both the first intersection area $115_1$ of the square base 110 and a first intersection area $125_1$ of the round base 120.

Referring still to FIG. 1, the round base 120 is formed by two intersecting perimeter edge elements 121 and 122 oriented substantially perpendicular to each other, where an area of intersection is proximate to the first ends of the perimeter edge elements 121 and 122. An arc-shaped segment 123 with a selected radius of curvature (R=4.35 inches) is configured to interconnect the second ends of the perimeter edge elements 121 and 122. As a result, the round base 120 results in a quadrant-shaped component (e.g., quarter circle). Herein, the first base fastener 140 may be positioned over a recessed mid-section of both the first perimeter edge element 111 of the square base 110 and the first perimeter edge element 121 of the round base 120 to securely fasten the square base 110 to the round base 120.

The octagon base 130 includes the first perimeter edge element 131 along with a second perimeter edge element 132, a third perimeter edge element 133, and a fourth perimeter edge element 134. As shown, according to one embodiment of the disclosure, the first perimeter edge element 131 of the octagon base 130 may be positioned adjacent to a perimeter edge element of another base, such as the second perimeter edge element 122 of the round base 120. According to this illustrative example, the second base fastener 142 may be positioned over a recessed mid-sections of both the second perimeter edge element 122 of the round base 120 and the first perimeter edge element 131 of the octagon base 130 to securely fasten the round base 120 to the octagon base 130.

An intersecting area 135 between the first perimeter edge element 131 and the fourth perimeter edge element 134 of the octagon base 130 includes a recessed connector to receive the first end of a right-angled post $150_4$, as shown. Although, it is contemplated that a straight-angled post may be positioned partially within the recessed connector provided that recessed connector of another base is suitably positioned in close proximity to allow for both ends of the straight-angled post to be inserted therein. Further, as shown, the intersection area between the second perimeter edge element 132 and the third perimeter edge element 133 of the octagon base 130 features a recessed connector pair that is configured to receive a first end connector of an obtuse-angled post 160. As shown, the obtuse-angled post 160 provides connectivity to a second octagon base 135 positioned above the octagon base 130.

Figure 11:
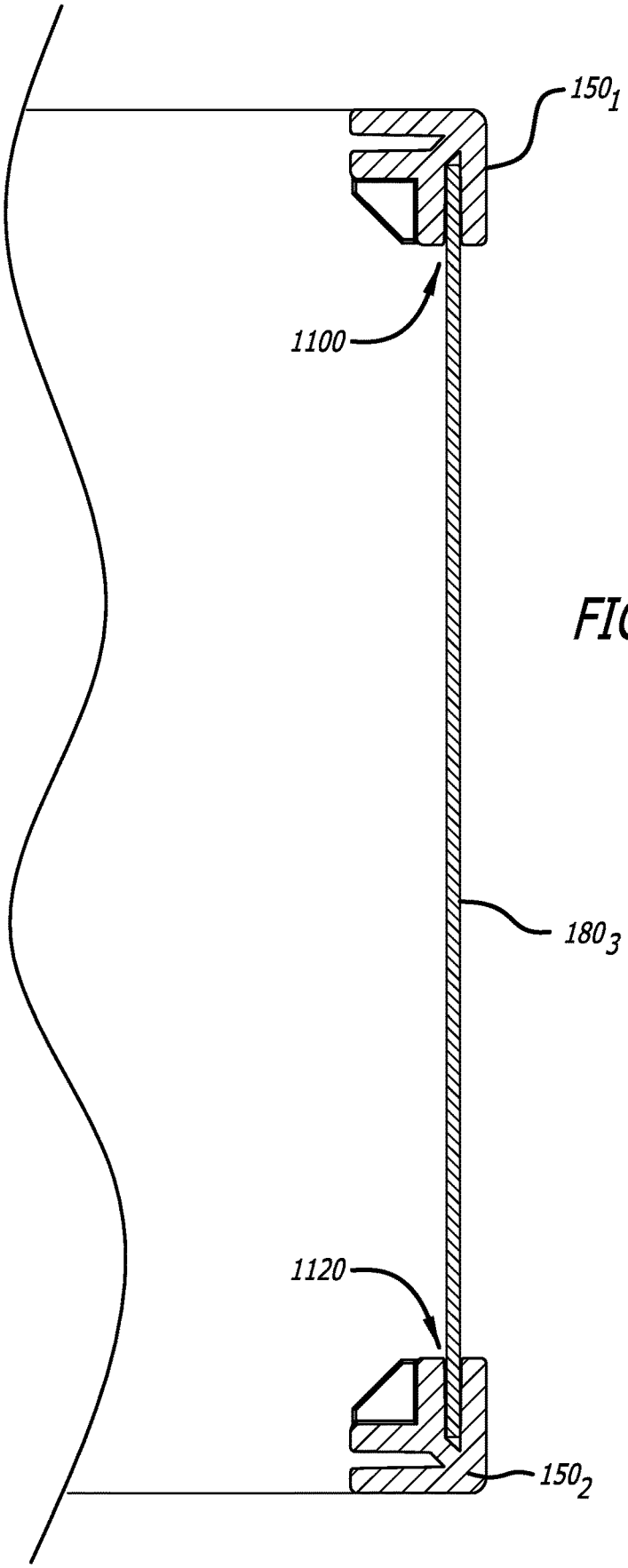
FIG. 11 is a horizontal cross-sectional view of a covering material installed side surface of the toy assembly system of FIG. 1 along lines 11-11 to represent the covering material being supported by right-angled caps mounted on neighboring right-angled posts.
Figure 12:
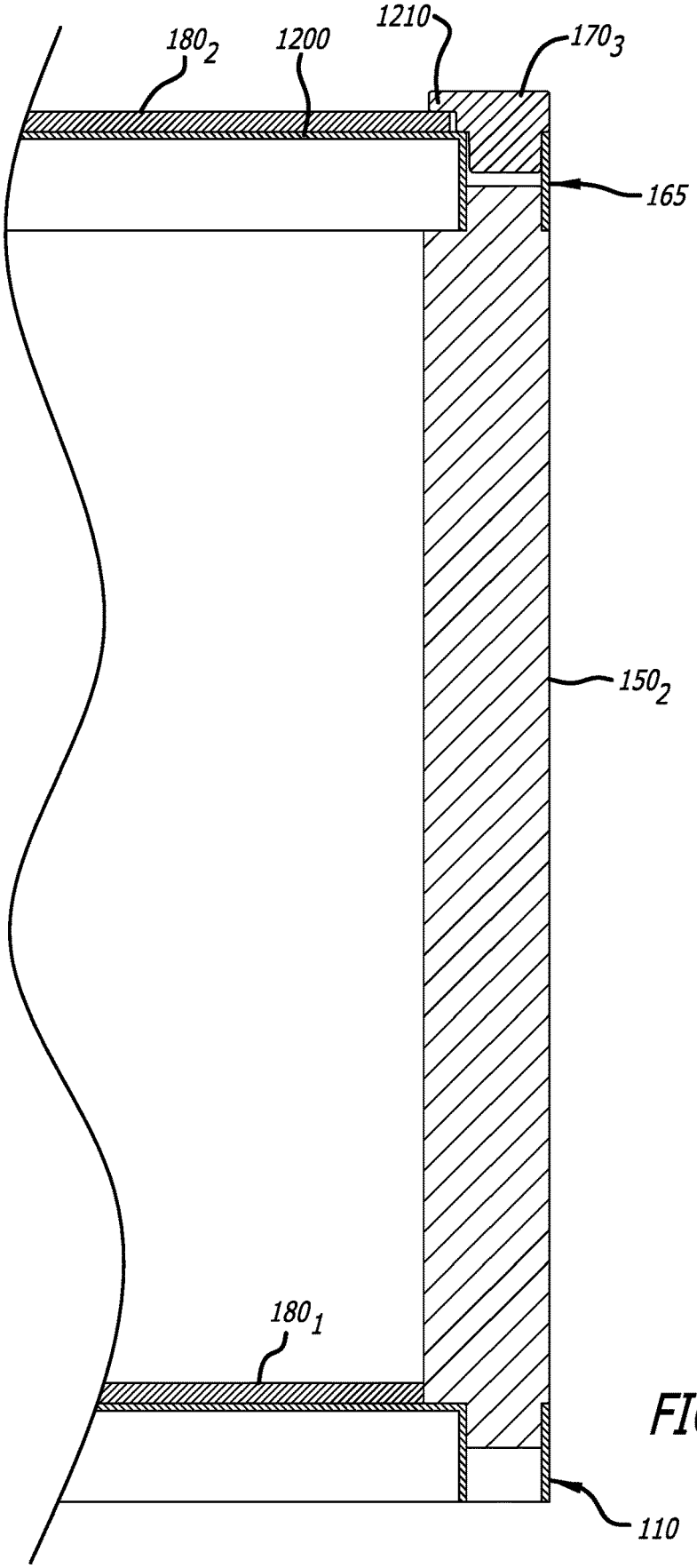
FIG. 12 is a vertical cross-sectional view of a covering material installed side surface of the toy assembly system of FIG. 1 along lines 12-12 to represent the covering material being supported by an edge connector of a right-angled post and a connector of the right-angled cap mounted on the right-angled post.

Formed within each of the posts $150_1$-$150_4$, 155 and 160, one or more vertically-oriented slots are configured to allow for insertion and retention of covering material 180 therein. The covering material 180 may be in a form of a planar piece of material upon which images may be drawn or printed (e.g., a piece of paper, cardstock, a hardened plastic sheet, tin foil, etc.). The covering material 180 may be used to enhance a physical form of the toy. For instance, as shown in FIG. 1, a first covering $180_1$ may be sized for placement over a top surface of the square base 110 while a second covering $180_2$ may be sized for placement over a top surface of the second square base 165. A third covering material $180_3$ may be positioned within vertically-oriented slots within the posts $150_1$ and $150_2$, which at least partially secure the third covering $180_3$ to the toy framework 105. An example of the connectivity of the covering materials $180_1$-$180_3$ to the framework 105 is shown in FIGS. 11-12 and described below.

As further shown in FIG. 1, the toy assembly system 100 may further include a right-angled cap $170_1$ that is aligned with a portion of an end connector of the straight-angled post 155 along with right-angled caps $170_2$-$170_4$ that are aligned with end connectors of the posts $150_1$-$150_3$. For this embodiment, the right-angled caps $170_1$-$170_4$ are placed at the corners of the second square base 165. The right-angled caps $170_1$-$170_4$ further include a ledge portion that is configured to secure (retain) a covering when the covering is oriented as a surface covering as well as one or more slots that are configured to receive and secure coverings when oriented as sidewalls within the framework 105. Upon installation, slots of a right-angled cap (e.g., cap $170_4$) may be aligned with slots formed within a corresponding posts (e.g., right-angled post $150_3$).

Figure 2:
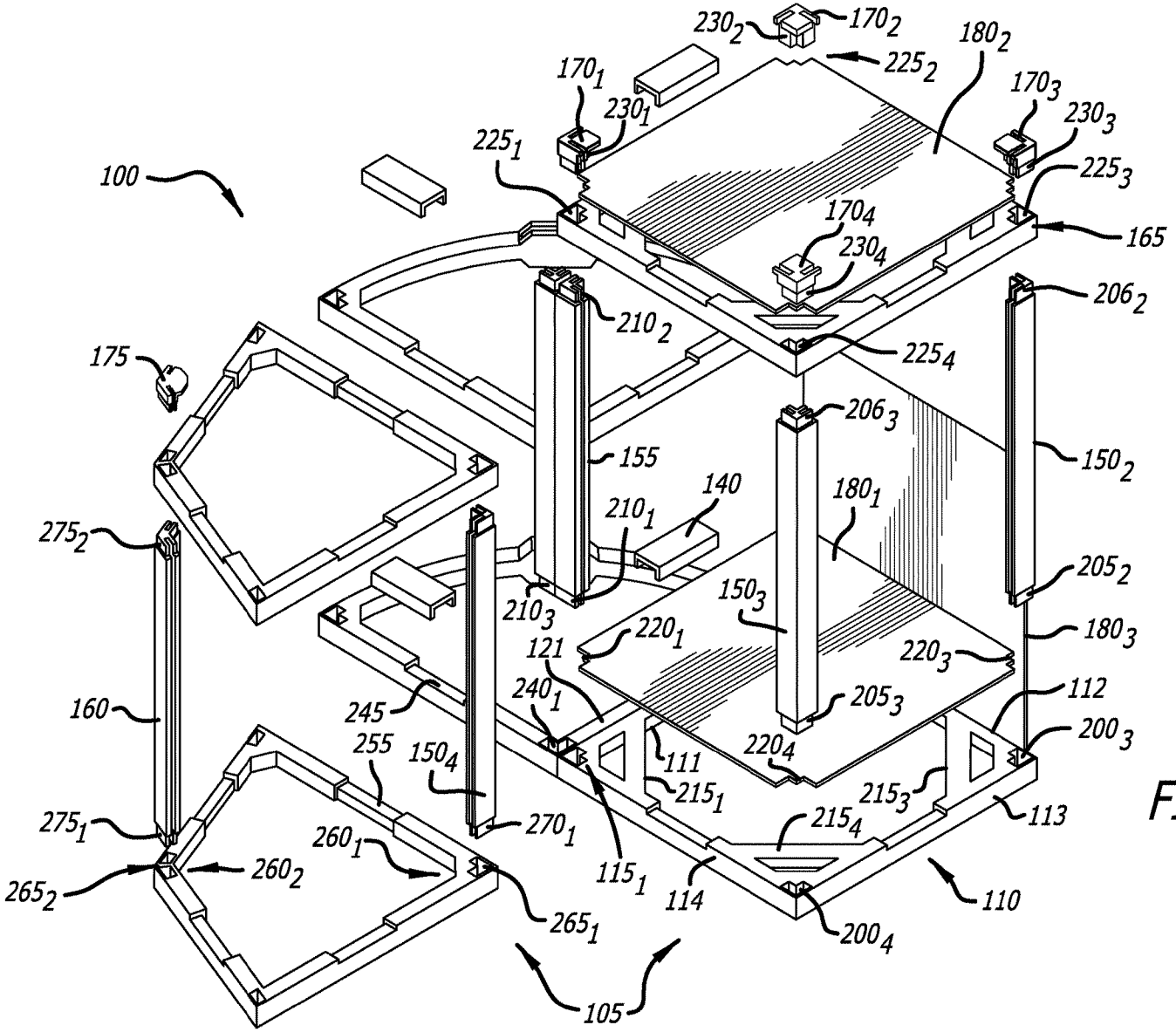
FIG. 2 is an exploded view of the exemplary embodiment of the toy assembly system of FIG. 1.

Referring now to FIG. 2, an exploded view of the exemplary embodiment of the toy assembly system 100 of FIG. 1 is shown. Herein, the square base 110 includes recessed connectors $200_1$-$200_4$ positioned at the intersection areas (corners) $115_1$-$115_4$ of the square base 110. Each of the recessed connectors $200_2$, $200_3$ or $200_4$ features a general L-shaped cross-section that corresponds to a cross-sectional shape of a first (protruding) end connector $205_1$, $205_2$ or $205_3$ of a right-angled post $150_1$, $150_2$ or $150_3$, respectively. Recessed connector $200_1$ generally features an L-shaped cross-section suitable for an end connector of a right-angled post or a portion of a first end connector $210_1$ of a straight-angled post 155.

The square base 110 further includes a buttress portion $215$-$215_4$ coupled at both ends to different perimeter edge elements, which provide rigidity to the square base 110 and a structure upon which a portion of a bottom surface of the covering material $180_1$ may rest. Each corner of the covering material $180_1$ may include a cut-out regions $220_1$-$220_4$ that matches (and aligns with) an outer surface pattern of the recessed connectors $200_1$-$200_4$ so as not to obstruct the first end connector $210_1$ of the post 155 and first end connectors $210_2$-$210_4$ of the posts $150_1$-$150_3$ when inserted into the recessed connectors $200_1$-$200_4$, respectively. Also, a portion of the covering $180_1$ may reside under a traversing member of a post, as described below.

Herein, to provide depth to the framework 105, the second square base 165 may overlay the square base 110 so that second end connectors $206_1$-$206_3$ of the right-angled posts $150_1$-$150_3$ are inserted into a bottom portion of the recessed connectors $225_2$-$225_4$ of the square base 165 and secured therein. A portion of a second end connector $210_2$ of the straight-angled post 155 is inserted into a bottom end of a recessed connector $225_1$ of the square base 165 and secured therein. Similarly, the right-angled cap $170_1$-$170_4$ may include end connectors $230_1$-$230_4$ with the same cross-sectional pattern as recessed connectors $225_1$-$225_4$ of the second square base 165. For example, as shown for illustrative purposes, the end connectors $230_1$-$230_4$ of the right-angled caps $170_1$-$170_4$ are inserted into a top portion of the recessed connectors $225_1$-$225_4$ of the square base 165.

As further shown in FIG. 2, the straight-angled post 155 includes the first end connector $210_1$ that is sized for insertion into the recessed connector $200_1$ of the square base 110 and a third end connector $210_3$ is sized for insertion into a recessed connector of another base such as recessed connector $240_1$ of the round base 120 as shown. Herein, the cross sectional area of the first end connector $210_1$ of the straight-angled post 155 is generally equivalent to a cross-sectional area of the end connector of a right-angled post and a "mirrored" end connector $210_3$ being a reflected duplication of this end connector $210_1$, as shown.

Herein, the first base fastener 140 is positioned and snugly fit and partially surround the recessed mid-sections of both the first perimeter edge element 111 of the square base 110 (similar as the mid-section of the third perimeter edge element 113) and the first perimeter edge element 121 of the round base 120. Similarly, the second base fastener 142 is sized and positioned to snugly fit around a mid-section 245 of the second perimeter edge element 122 of the round base 120 and a mid-section 255 of the first perimeter edge element 131 of the octagon base 130.

As still shown in FIG. 2, the octagon base 130 may include recessed connectors that are positioned at different element intersection areas $\mathbf{260}_1$-$\mathbf{260}_2$, which are configured to maintain different post types, such as a first intersection area $\mathbf{260}_1$ that includes a recessed connector $\mathbf{265}_1$ configured to receive an end connector of a right-angled or a straight-angled post (e.g., a first end connector $\mathbf{270}_1$ of the right-angled post $\mathbf{155}_4$) and a second intersection area $\mathbf{260}_2$ that includes a recessed connector $\mathbf{265}_2$ configured to receive a first end connector $\mathbf{275}_1$ of the obtuse-angled post 160. The recessed connector $\mathbf{265}_2$ configured to support the obtuse-angled post 160 is formed by multiple, separate recesses angled from each by approximately 120 degrees to allow for insertion of the first end connector $\mathbf{275}_1$ of the obtuse-angled post 160. A second layer (or level) of the toy assembly system 100 may be formulated by placement of any suitable base member above a corresponding base member with base fasteners to maintain connectivity between different bases.

Referring now to FIG. 3A, a perspective view of an exemplary embodiment of a right-angled post (e.g., post $\mathbf{150}_3$) of the toy assembly system 100 of FIGS. 1-2 is shown. Herein, features a multi-layer construction extending from each end connector $\mathbf{205}_3$ and/or $\mathbf{206}_3$ as well as through body elements 315 and 325. More specifically, the right-angled post $\mathbf{150}_3$ includes the first end connector $\mathbf{205}_3$ and the second end connector $\mathbf{206}_3$. As the first end connector $\mathbf{205}_3$ and the second end connector $\mathbf{206}_3$ are of similar construction, a detailed description of the second end connector $\mathbf{206}_3$ provided below is applicable to the first end connector $\mathbf{205}_3$.

Herein, the second end connector $\mathbf{206}_3$ operates as a multi-layer right-angled protruding connector, including a first right-angled protrusion 310 and a second right-angled protrusion 320. The first right-angled protrusion 310 extends from a first edge 314 of an inner post body 315, while the second right-angled protrusion 320 extends from a first edge 324 of an outer post body 325. Herein, the first (inner post) body element 315 includes a first elongated member 316 and a second elongated member 317 forming side portions of an elongated cavity (e.g., V-shaped cavity). A first traversing member 318 extends between sidewalls of the first edge 314 are arranged to contact a top surface of another base member or covering material when inserted into a bottom portion of a recessed connector of that base member. At least a second traversing member 319 is arranged to contact a bottom surface of a base member or covering material when the end connector $\mathbf{206}_3$ is inserted into a recessed connector of a base member (e.g., square base 165 of FIGS. 1-2.). Similarly, the second (outer post) body element 325 includes a third elongated member 326 and a fourth elongated member 327 forming side portions of an elongated cavity (e.g., V-shaped cavity).

Herein, as shown in both FIGS. 3A-3B, the first right-angled protrusion 310 includes protrusion segments 312-313 arranged at a right angle that is substantially equal to ninety degrees with tolerance offsets (e.g., a right angle may ranging from 85-95 degrees). Similarly, the second right-angled protrusion 320 includes protrusion segments 322-323 arranged at an angle substantially equal to ninety degrees (e.g., an angle ranging from 85-95 degrees). As shown, at vertices of the first right-angled protrusion 310 and the second right-angled protrusion 320 (areas of intersection between right-angled protrusion segments 312-313 and between protrusion segments 322-323), a bridge member 330 couples the first right-angled protrusion 310 to the second right-angled protrusion 320. Otherwise, the segments 312-313 of the first right-angled protrusion 310 remain spatially separated from the segments 322-323 of the second right-angled protrusion 320.

In particular, as shown in FIG. 3B, the bridge member 330 is coupled to the first right-angled protrusion 310 to the second right-angled protrusion 320 and forms a first slot 340 and a second slot 345. The first slot 340 is formed between a first protrusion segment 312 of the of the first right-angled protrusion 310 and a first protrusion segment 322 of the second right-angled protrusion 320. The first slot 340 continues longitudinally over an entire longitudinal length of the first and second elongated members of the right-angled post $\mathbf{150}_3$; namely, the first slot 340 extends from the second end connector $\mathbf{206}_3$, over the elongated members 316 and 326, and to and through the first end connector $\mathbf{205}_3$. The second slot 345 is formed between a second protrusion segment 313 of the first right-angled protrusion 310 and a second protrusion segment 323 of the second right-angled protrusion 320. Like the first slot 340, the second slot 345 continues longitudinally over an entire length of the right-angled post $\mathbf{150}_3$; namely, the second slot 345 extends from the second end connector $\mathbf{206}_3$, over the elongated members 317 and 327, and to and through the first end connector $\mathbf{205}_3$.

Referring to FIG. 4A, a perspective view of an exemplary embodiment of an obtuse-angled post 160 of the toy assembly system 100 of FIGS. 1-2 is shown. Herein, the obtuse-angled post 160 includes the first end connector $\mathbf{275}_1$ and a second end connector $\mathbf{275}_2$. Herein, the first end connector $\mathbf{275}_1$ and the second end connector $\mathbf{275}_2$ are of similar construction, and thus, a detailed description of the second end connector $\mathbf{275}_2$ provided below is applicable to the first end connector $\mathbf{275}_1$.

The second end connector $\mathbf{275}_2$ includes a first protrusion 410 and a second protrusion 420, which are separated by a spacing 430. The first protrusion 410 is angularly offset from the second protrusion 420 such as an interior angle, formed by a first plane including an interior surface 411 of the first protrusion 410 and a second plane including an interior surface 421 of the second protrusion 420, corresponds to an obtuse angle A (e.g., angle >90° such as angle) 120°.

As shown in FIG. 4A, the first protrusion 410 includes a first protrusion segment 412 extending from a first edge 414 of an inner post body 415 and a second protrusion segment 416 extending from a first edge 424 of an outer post body 425. Similarly, the second protrusion 420 includes a third protrusion segment 422 extending from the first edge 414 of the inner post body 415 and a fourth protrusion segment 426 extending from the first edge 424 of the outer post body 425. Herein, a slot 440 is formed between the inner post body 415, which includes a first elongated member 416 and a second elongated member 417 forming side portions of an elongated cavity (e.g., V-shaped cavity), and the outer post body 425 including elongated members 426 and 427 forming side portions of an elongated cavity (e.g., V-shaped cavity).

A second traversing member 418 and the first edge 414 may be arranged to contact a top surface of another base member (e.g., octagon member 130) or covering material when inserted into a recessed connector of that base member. Similarly, a first traversing member 419 may be arranged to contact a bottom surface of an octagon member when inserted into a recessed connector of the octagon member 135 (see FIGS. 1-2).

Herein, as shown in both FIGS. 4A-4B, the first protrusion 410 includes protrusion segments 412 and 416 arranged at an angle substantially less than 180 degrees (e.g., angle ranging from 110-130 degrees and approximately 120°) from counterpart protrusion segments 422 and 426 of the second protrusion 420. Herein, protrusion segments 412 and 416 and protrusion segments 422 and 426 remain spatially separated from each other to form a slot 440 and 445, respectively.

In particular, as shown in FIG. 4B, the slot 440 continues longitudinally over an entire longitudinal length of the obtuse-angled post 160; namely, the first slot 440 extends from the second end connector $\mathbf{275}_2$ to and through the first end connector $\mathbf{275}_1$. Like the first slot 440, the second slot 445 continues longitudinally over an entire length of the obtuse-angled post 160 from the second end connector $\mathbf{275}_2$ to and through the first end connector $\mathbf{275}_1$.

Figure 5A:
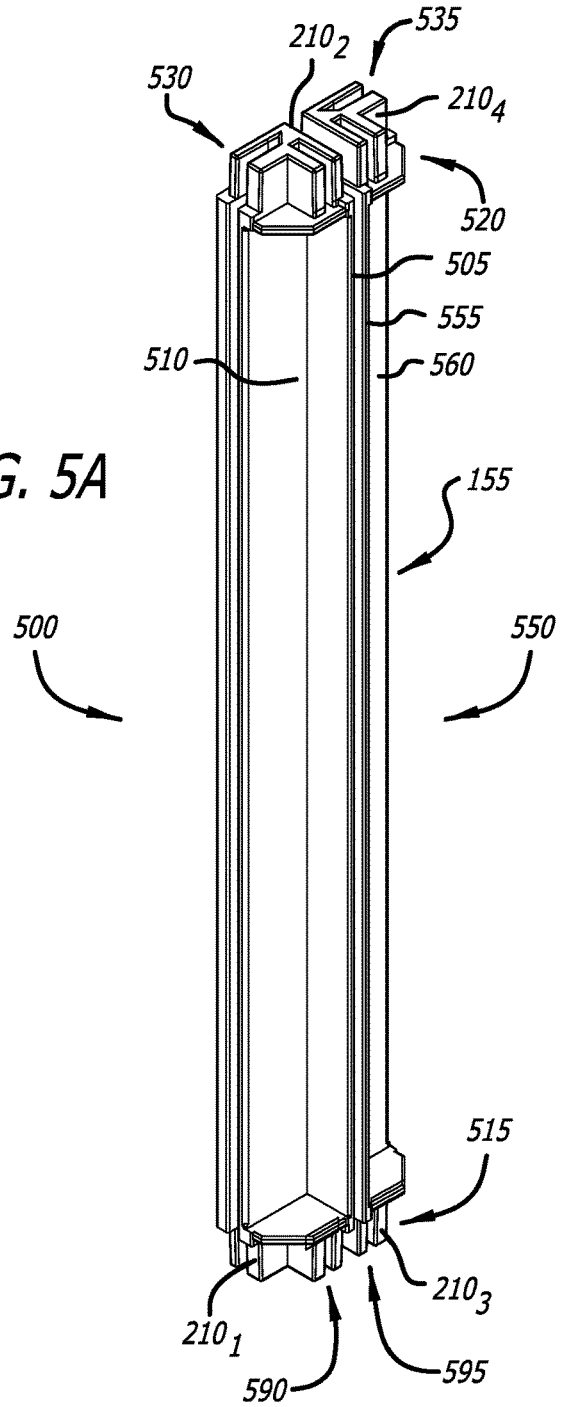
FIG. 5A is a perspective view of an exemplary embodiment of a straight-angled post of the toy assembly system of FIGS. 1-2.

Referring now to FIG. 5A, a perspective view of an exemplary embodiment of a straight-angled post (e.g., post 155 of the toy assembly system 100 of FIGS. 1-2) is shown. Herein, the straight-angled post 155 is an assembly of two right-angled posts 500 and 550 that are oriented so that a first elongated member 505 forming a side portion of an elongated cavity 510 (e.g., V-shaped cavity) of the first right-angled post 500 is in parallel with a second elongated member 555 forming a side portion of an elongated cavity 560 of the second right-angled post 550. As a result, the first right-angled post 500 and the second right-angled post 550 are oriented in a mirrored deployment.

More specifically, the straight-angled post 155 includes a first connecting end 515 and a second connecting end 520. The first connecting end 515 includes the first end connector $\mathbf{210}_1$ and the third end connector $\mathbf{210}_3$, both of which may be sized for insertion into recessed connectors of neighboring bases (e.g., recess connectors of the square base 110 and the round base 120 of FIGS. 1-2). Similar in architecture, the second connecting end 520 includes a second end connector $\mathbf{210}_2$ and a fourth end connector $\mathbf{210}_4$, both of which may be sized for insertion into recessed connectors of neighboring bases (e.g., recess connectors of the square base 165 and an adjacent round base 195 of FIG. 1) and feature generally equivalent architecture as the first connecting end 515. Herein, for illustrative purposes, discussion of the particulars of an end connector of the straight-angled post 155 is directed to the second connecting end 520.

Herein, the second connecting end 520 of the straight-angled post 155 is arranged with the second end connector $\mathbf{210}_2$ and the fourth end connector $\mathbf{210}_4$, which is equivalent in construction to the second end connector $\mathbf{210}_2$ but situated in a "mirrored" deployment. More specifically, the second end connector $\mathbf{210}_2$ includes a first set of protrusion segments 530 arranged at approximately ninety degrees (e.g., angle ranging from 85-95 degrees) from each other. Similarly, the fourth end connector $\mathbf{210}_4$ includes a second set of protrusion segments 535 are arranged at approximately ninety degrees from each other to mimic the construction of the first set of protrusion segments 530.

Figure 5B:
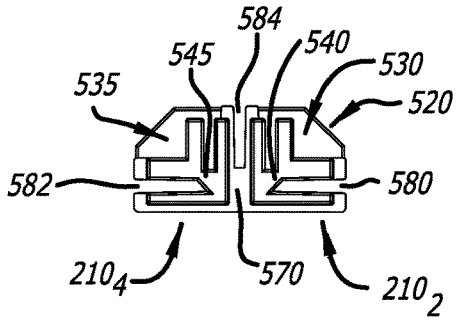
FIG. 5B is a top or bottom plan view of a connector for the straight-angled post of FIG. 5A.

As shown in FIG. 5B, positioned between vertices formed by the first set of protrusion segments 530, a first bridge member 540 couples the first set of protrusion segments 530 together. Similarly, a second bridge member 545 couples the second set of protrusion segments 535 together. A third bridge member 570 is configured to couple the first set of protrusion segments 530 to the second set of protrusion segments 535. Otherwise, the first set of protrusion segments 530 remain spatially separated from the second set of protrusion segments 535 to form a first slot 580, a second slot 582 and a third slot 584.

Additionally, the first connecting end 515 includes the first end connector $\mathbf{210}_1$ and the third end connector $\mathbf{210}_3$. Similar in architecture to the second and forth end connectors $\mathbf{210}_2$ and $\mathbf{210}_4$, the first and third end connectors $\mathbf{210}_1$ and $\mathbf{210}_3$ includes sets of protrusion segments 590 and 595 arranged for insertion into recessed connectors of various type of base structures (e.g., square, round, etc.).

Figure 6A:
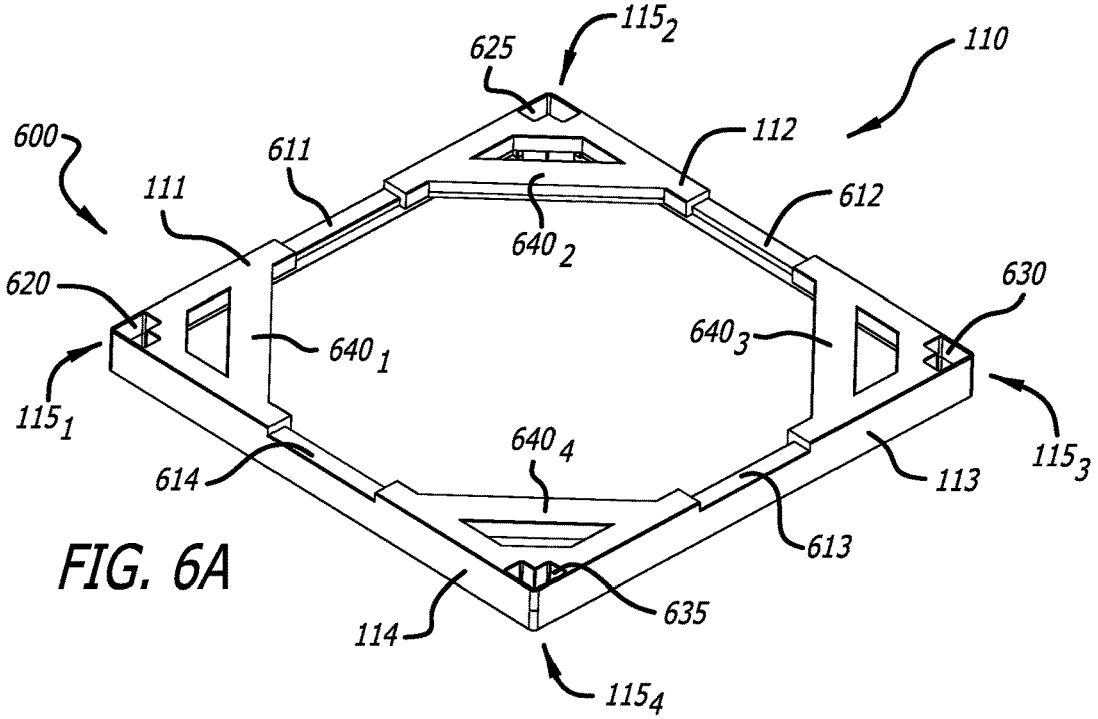
FIG. 6A is an elevated, perspective view of the square base of FIGS. 1-2.

Referring now to FIG. 6A, an elevated, perspective view of the square base 110 of FIGS. 1-2 is shown. Herein, the square base 110 features a perimeter 600 formed by the first perimeter edge element 111, the second perimeter edge element 112, the third perimeter edge element 113, and the fourth perimeter edge element 114. According to one embodiment of the disclosure, each of the perimeter edge elements 111-114 may be of an equal length (e.g., a few inches such as five inches), although one or more of these perimeter edge elements 111-114 may differ from each other so that the square base 110 actually represent a selected type of polygon.

Figure 6B:
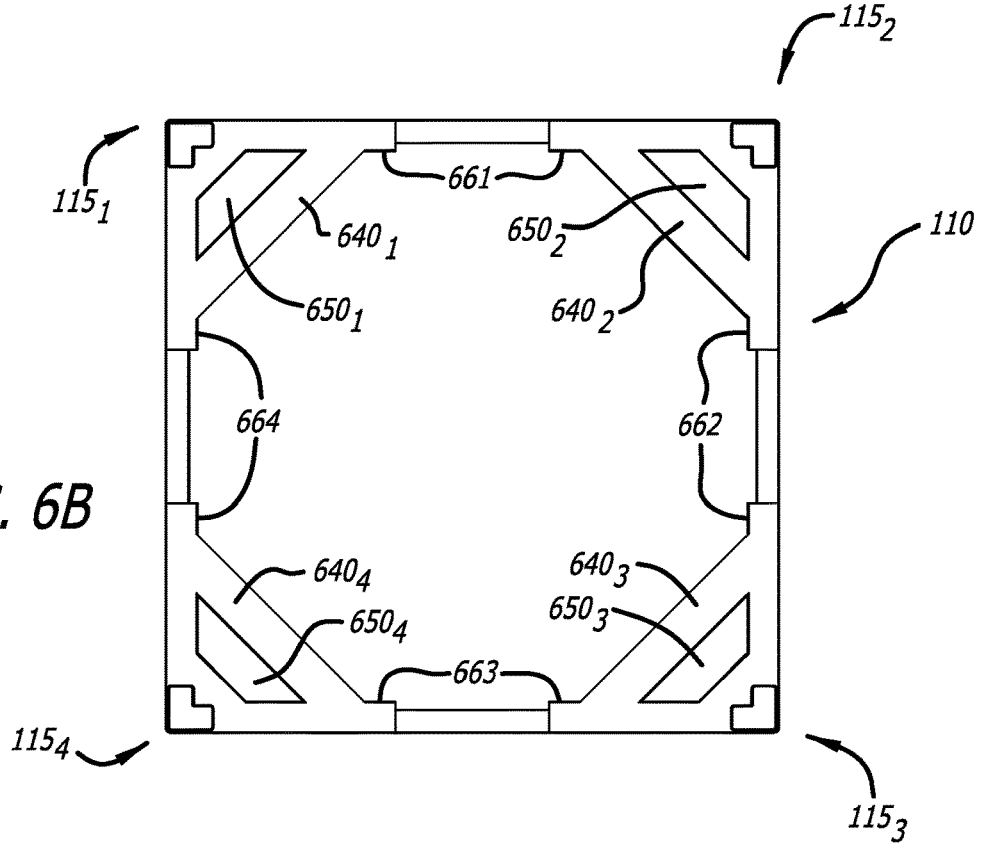
FIG. 6B is a top plan view of the square base of FIG. 6A.

As shown in both FIGS. 6A-6B, each of these perimeter edge elements 111-114 include a cut-out region 611-614 that results in a section of the perimeter edge elements 111-114 having a different (and lesser) depth than other sections of the perimeter edge elements 111-114. For illustrative purposes, the cut-out regions 611-614 are located at a middle section (hereinafter, "mid-section") for each perimeter edge element 111-114, although it is contemplated that the cut-out regions 611-614 may be located at different sections of the perimeter edge elements 611-614 other than the mid-section. The ratio of the length of each cut-out region 611-614 in comparison with a length of its corresponding perimeter edge element may be less than 1:4 (e.g., length of cut-out region 611 may be equal to or less than 1.25 inches when the length of the perimeter edge element 111 is equal to greater than 5 inches).

Each cut-out region 611-614 is sized with a depth so that, if a base fastener is connected to that cut-out region, the top surface of a base fastener will be substantially co-planar to the top surfaces of the sections of the perimeter edge elements 111-114 neighboring the cut-out regions 611-614. Also, the widths of the perimeter edge element portions within the cut-out region 611-614 are lesser in width than the neighboring perimeter edge element sections, where the reduction in width may be selected to be equivalent to and to account for the thickness of a sidewall of the base fastener when attached to the cut-out region 611 . . . or 614. As a result, when attached, an outer surface of the sidewalls of the base fastener would be substantially co-planar with an inner side surface 661-664 of the perimeter edge elements 111-114, respectively.

Also, each perimeter edge element 111-114 is coupled to at least two neighboring perimeter edge elements. For instance, the first perimeter edge element 111 is joined to the fourth perimeter edge element 114 to form the first interception (corner) area $\mathbf{115}_1$ while the first perimeter edge element 111 is also joined to the second perimeter edge element 112 to form the second intersection area $\mathbf{115}_2$. In a similar construction, the second perimeter edge element 112 is joined to the third perimeter edge element 113 to form the third intersection area $\mathbf{115}_3$ while the third perimeter edge element 113 is joined to the fourth perimeter edge element 114 to form the fourth intersection area $\mathbf{115}_4$.

As shown in more detail in FIG. 6A, recessed connectors 620, 625, 630 and 635 are formed within intersection areas $\mathbf{115}_1$-$\mathbf{115}_4$ of the square base 110. According to one embodiment of the disclosure, each of the recessed connectors 620, 625, 630 and 635 are formed for receipt of an end connector of a right-angled post or a portion of an end connector of a straight-angled post. Positioned diagonally oriented from each of the intersection areas $\mathbf{115}_1$-$\mathbf{115}_4$, a corresponding buttress element $\mathbf{640}_1$-$\mathbf{640}_4$ is coupled to the pair of neighboring perimeter edge elements forming the square base 110 and a support surface for covering material deposited thereon.

Referring only to FIG. 6B, a top plan view of the square base 110 of FIG. 6A is shown. Herein, buttress elements $\mathbf{640}_1$-$\mathbf{640}_4$ are formed to provide a spacing $\mathbf{650}_1$-$\mathbf{650}_4$ between these elements $\mathbf{640}_1$-$\mathbf{640}_4$ and their corresponding intersection areas $\mathbf{115}_1$-$\mathbf{115}_4$ of the square base 110. Also, the cut-out regions 611-614 may be positioned at the mid-section of each perimeter edge element 111-114. The buttress elements $\mathbf{640}_1$-$\mathbf{640}_4$ may be any shape but are designed to provide rigidity to the square base 110.

Figure 7A:
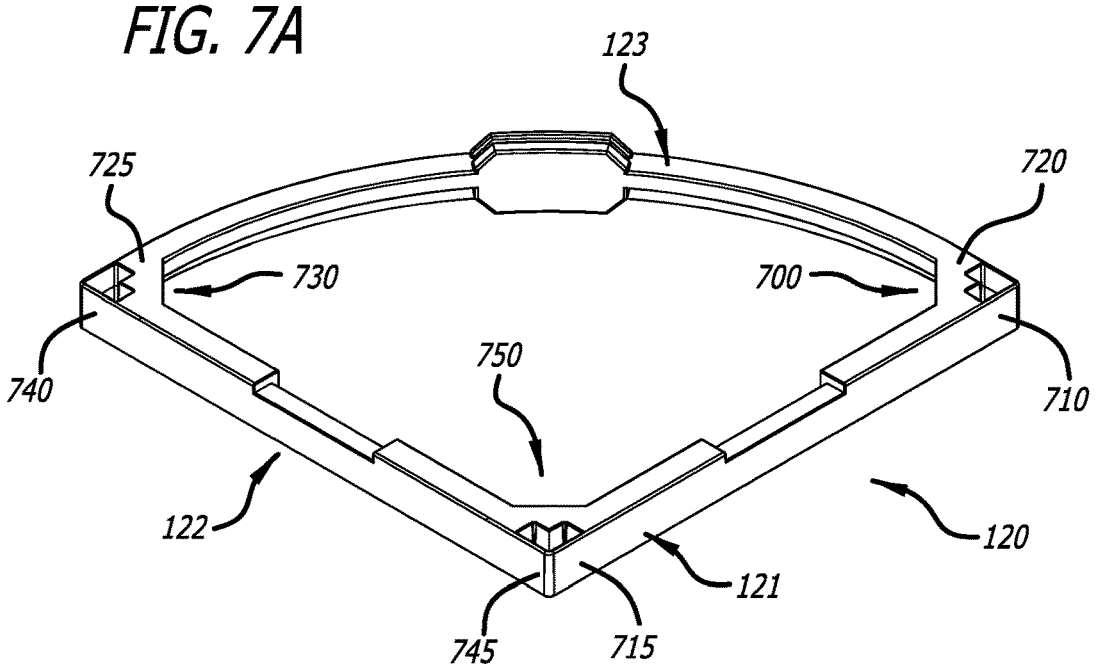
FIG. 7A is an elevated, perspective view of the round base of FIGS. 1-2.

Referring to FIG. 7A, an elevated, perspective view of the round base 120 of FIGS. 1-2 is shown. Herein, the round base 120 features a quadrant (quarter circle) with the first perimeter edge element 121, the second perimeter edge element 122, and the arc-shaped segment 123. Herein, according to this embodiment of the disclosure, a first intersection area 700 is situated proximate to a joining of a first end 710 of the first perimeter edge element 121 and a first end 720 of the arc-shaped segment 123. Similar, a second intersection area 730 is situated proximate to a joining of a first end 740 of the second perimeter edge element 122 and a second end 725 of the arc-shaped segment 123. Also, a third intersection area 750 may be situated proximate to a joining of a second end 715 of the first perimeter edge element 121 and a second end 745 of the second perimeter edge element 122.

Figure 7B:
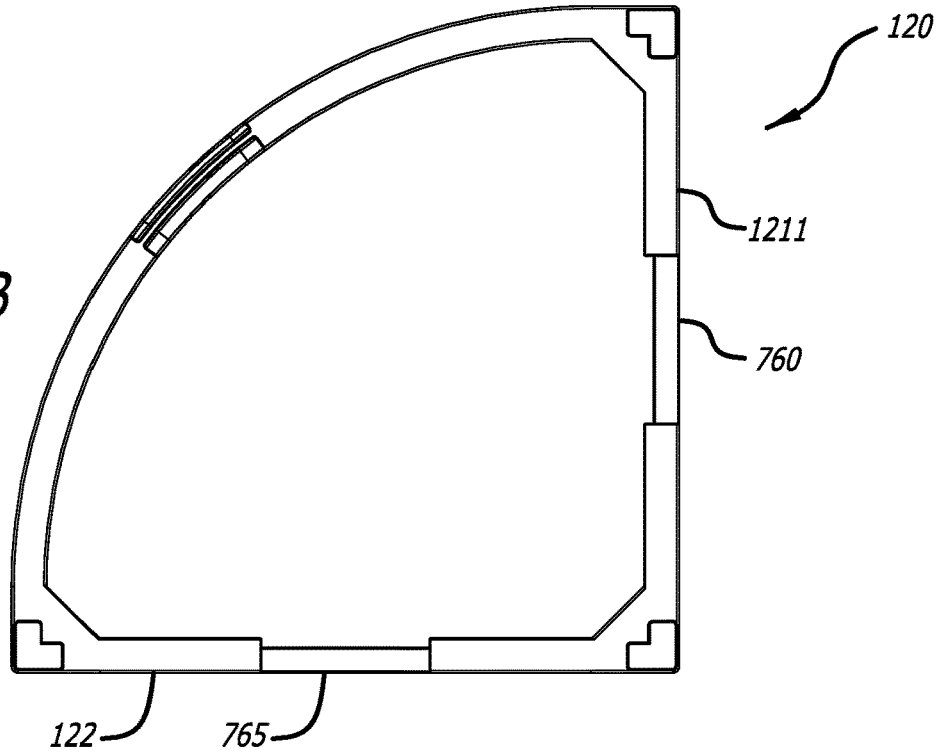
FIG. 7B is a top plan view of the round base of FIG. 7A.

Referring now to FIG. 7B, a top plan view of the round base 120 of FIG. 7A is shown. Herein, both the first perimeter edge element 121 and the second perimeter edge element 122 include a cut-out region 760 and 765, respectively. For this embodiment of the disclosure, the cut-out regions 760 and 765 corresponds to a region of the first perimeter edge element 121 and the second perimeter edge element 122 having a different (and lesser) depth than neighboring sections of the perimeter edge elements 121 and 122. Additionally, each of the cut-out regions 760 and 765 may be configured with a lesser width than the neighboring perimeter edge element sections, as described above.

For illustrative purposes, the region is located as a mid-section portion for each perimeter edge element 121-122, although it is contemplated that the cut-out regions 760 and 765 may be located at different regions along the perimeter edge elements 121 and 122 other than the mid-section. The cut-out regions 760 and 765 may be sized with a depth so that, if a base fastener is connected to a particular cut-out region, a top surface of the base fastener will be generally co-planar to the top surfaces of the neighboring sections of the perimeter edge elements 121 and 122, respectively.

Figure 8A:
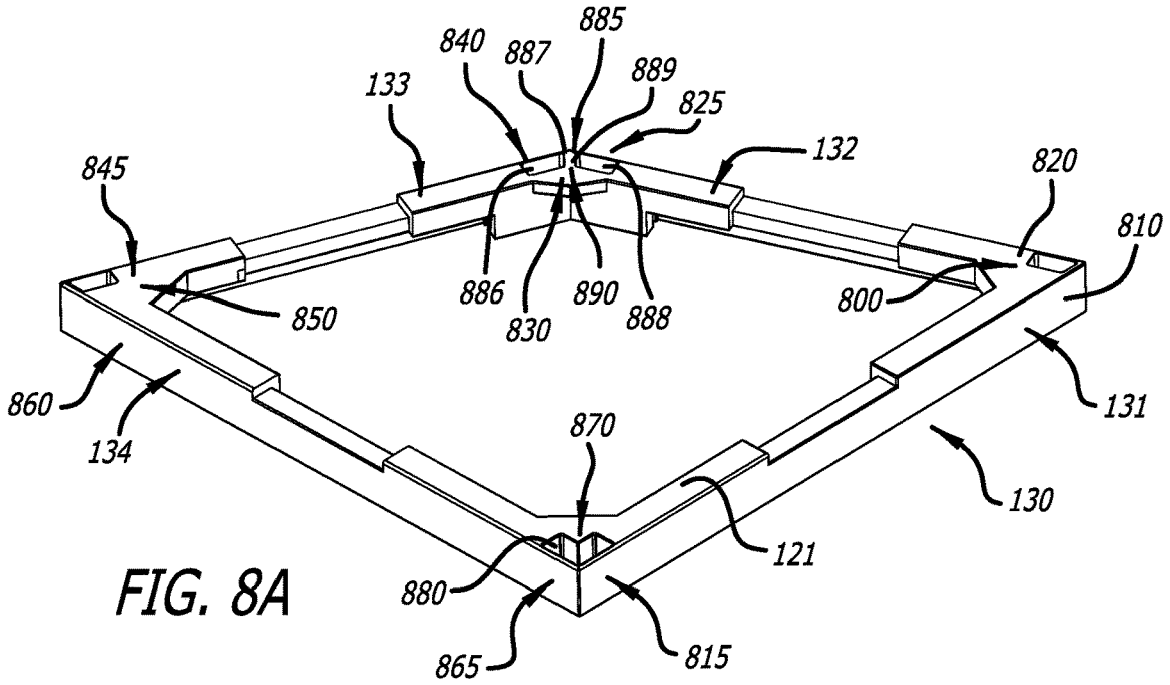
FIG. 8A is an elevated, perspective view of the octagon base of FIGS. 1-2.

Referring to FIG. 8A, an elevated, perspective view of the octagon base 130 of FIGS. 1-2 is shown. The octagon base 130 includes the first perimeter edge element 131, the second perimeter edge element 132, the third perimeter edge element 133, and the fourth perimeter edge element 134. As shown, according to this embodiment of the disclosure, a first intersection area 800 is situated proximate to a joining of a first end 810 of the first perimeter edge element 131 and a first end 820 of the second perimeter edge element 132. Similarly, a second intersection area 830 is situated proximate to a joining of a first end 840 of the third perimeter edge element 133 and a second end 825 of the second perimeter edge segment 132; a third intersection area 850 is situated proximate to a joining of a first end 860 of the fourth perimeter edge element 134 and a second end 845 of the third perimeter edge segment 133; and a fourth intersection area 870 is situated proximate to a joining of a second end 865 of the fourth perimeter edge element 134 and a second end 815 of the first perimeter edge segment 131.

Figure 8B:
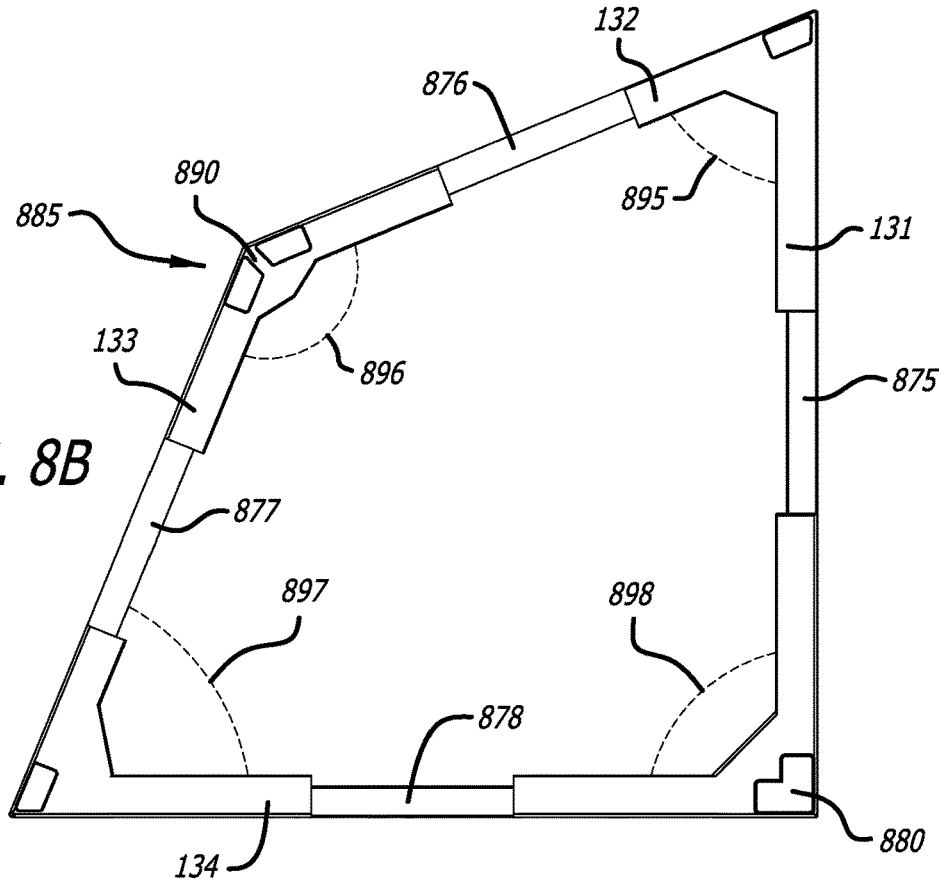
FIG. 8B is a top plan view of the octagon base of FIG. 8A.

As further shown in FIGS. 8A-8B, the fourth intersection area 870 of the octagon base 130 includes a recessed connector 880 configured to receive an end connector associated with a right-angled post or a partial end connector of a straight-angled post (provided another base is positioned with a perimeter edge element adjacent to the first perimeter edge element 131). Further, as shown, the second intersection area 850, positioned between the second perimeter edge element 132 and the third perimeter edge element 133 of the octagon base 130, features a recessed connector pair 885 that is configured to receive an end connector of an obtuse-angled post. The recessed connector pair 885 includes a first recessed connector 886 and a second connector 888, which is angularly offset by an obtuse angle while an inner side 887 of the first recessed connector 886 and an inner side 889 of the second recessed connector 888 remain in parallel with each other. A spacing 890 corresponding to a portion of the second intersection area 830 is present between the first recessed connector 886 and the second recessed connector 888.

Referring now to FIG. 8B, as shown by a top plan view of the octagon base 130, each of the perimeter edge elements 131-134 may include a cut-out regions 875-878 with the structure as described for cut-out regions 611-614 illustrated in FIGS. 6A-6B. Furthermore, both a first interior angle 895 between the first perimeter edge element 131 and the second perimeter edge element 132 and a third interior angle 897 between the third perimeter edge element 133 and the fourth perimeter edge element 134 corresponds to acute angles. A second interior angle 896 between the second perimeter edge element 132 and the third perimeter edge element 133 corresponds to obtuse angle while a fourth interior angle 898 between the fourth perimeter edge element 134 and the first perimeter edge element 131 generally corresponds to a right angle.

Figure 9A:
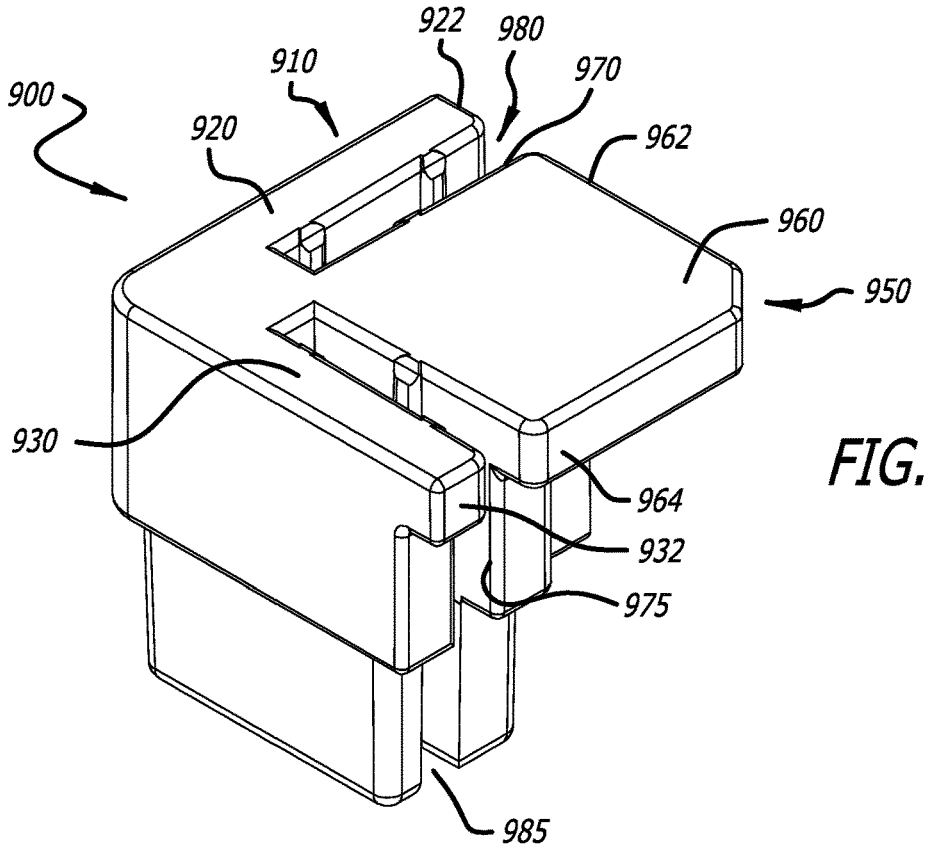
FIG. 9A is an elevated, perspective view of the right-angled cap of FIG. 1.

Referring to FIG. 9A, an elevated, perspective view of a right-angled cap 900, such as right-angled cap $\mathbf{170}_1$ of FIG. 1, is shown. The right-angled cap 900 features an angular border section 910 and an interior section 950. The angular border section 910 includes a pair of intersecting sidewalls 920 and 930 arranged vertically. The interior section 950 includes a polygon-shaped ledge portion 960, including (i) a first sidewall 970 extending vertically from the ledge portion 960 to form a first slot 980 between the sidewall 920 of the border section 910 and (ii) a second sidewall 975 extending vertically from the ledge portion 960 to form a second slot 985 between the sidewall 930 of the border section 910.

Figure 9B:
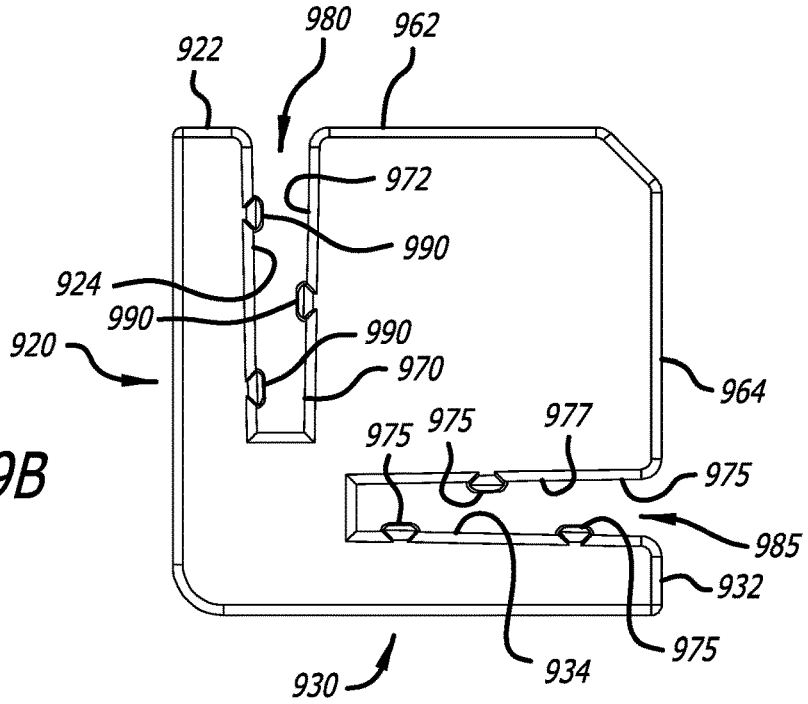
FIG. 9B is a top plan view of the right-angled cap of FIG. 9A.

Referring to FIG. 9B, a top plan view of the right-angled cap 900 of FIG. 9A is shown. Herein, the sidewall 920 of the border section 910 extends so that an edge 922 of the sidewall 920 is generally co-planar to a first edge 962 of the ledge portion 960. Also, the sidewall 930 of the border section 910 extends so that an edge 932 of the sidewall 930 is generally co-planar to a second edge 964 of the ledge portion 960. An interior surface 924 of the sidewall 920 and an interior surface 972 of the first sidewall 970 form the first slot 980, where the interior surface 924 and/or the interior surface 972 includes protrusions 990. These protrusions 990 are positioned to retain covering material (e.g., covering material 180 of FIGS. 1-2) positioned between a slot of the posts that may further be retained within the first slot 980. With a similar configuration, an interior surface 934 of the sidewall 930 and an interior surface 977 of the second sidewall 975 form the second slot 985, where the interior surface 934 and/or the interior surface 977 includes protrusions 995. These protrusions 995 are also positioned to retain covering material positioned between another slot of a post that may be aligned with the right-angled cap 900.

Figure 10A:
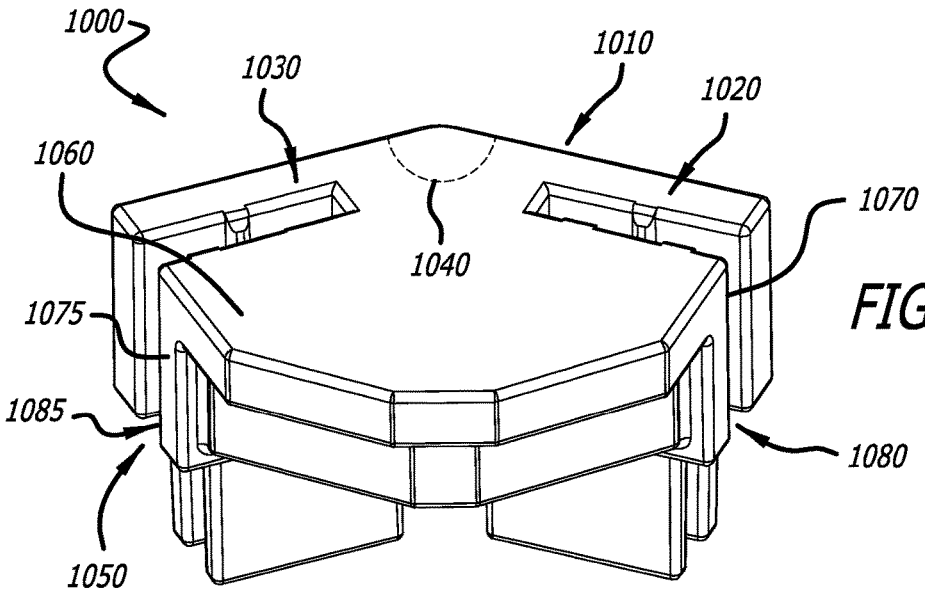
FIG. 10A is an elevated, perspective view of the obtuse-angled cap of FIG. 1.

Referring to FIG. 10A, an elevated, perspective view of the obtuse-angled cap 1000, such as of FIG. 1 is shown. The obtuse-angled cap 1000 features a border section 1010 and an interior section 1050. The border section 1010 includes a pair of sidewalls 1020 and 1030 arranged vertically and offset from each other by an obtuse interior angle 1040. The interior section 1050 includes a polygon-shaped ledge portion 1060 with (i) a first sidewall 1900 extending vertically from the ledge portion 1060 to form a first slot 1080 between the sidewall 1020 of the border section 1010 and (ii) a second sidewall 1075 extending vertically from the ledge portion 1060 to form a second slot 1085 between the sidewall 1030 of the border section 1010.

Figure 10B:
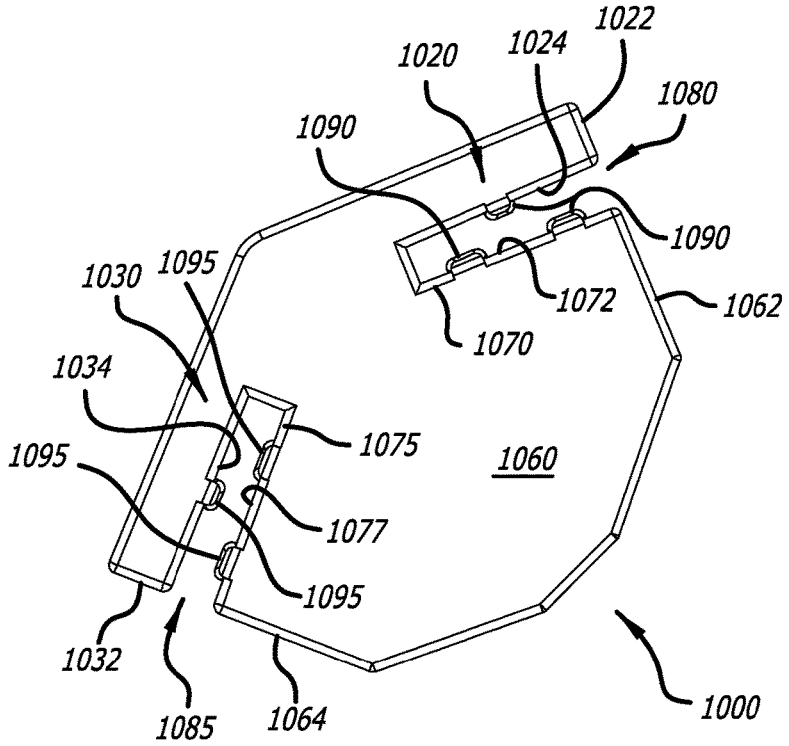
FIG. 10B is a top plan view of the obtuse-angled cap of FIG. 10A.

Referring now to FIG. 10B, a top plan view of the obtuse-angled cap 1000 of FIG. 10A is shown. Herein, the sidewall 1020 of the border section 1010 extends so that an edge 1022 of the sidewall 1020 is generally co-planar to a first edge 1062 of the ledge portion 1060. Also, the sidewall 1030 of the border section 1010 extends so that an edge 1032 of the sidewall 1030 is generally co-planar to a second edge 1064 of the ledge portion 1060. An interior surface 1024 of the sidewall 1020 and an interior surface 1072 of the first sidewall 1900 form the first slot 1080, where each of the interior surface 1024 and/or the interior surface 1072 may include one or more protrusions 1090. These protrusions 1090 are positioned to retain covering material positioned between the first slot 1080 and/or a slot of an obtuse-angled post. With a similar configuration, an interior surface 1034 of the sidewall 1030 and an interior surface 1077 of the second sidewall 1075 form the second slot 1085, wherein the interior surface 1034 and/or the interior surface 1077 may include one or more protrusions 1095. These protrusions 1095 are also positioned to retain covering material positioned between the second slot 1085 and another slot of the obtuse-angled post.

Referring to FIG. 11, a horizontal cross-sectional view of a portion of the framework of the toy assembly system 100 of FIG. 2 along lines 11-11 to illustrate retention of the covering material $\mathbf{180}_3$ installed to form a side surface of the toy assembly system 100 of FIG. 2. Herein, the first right-angled post $\mathbf{150}_1$ includes a slot 1100 extending between body elements of the first right-angled post $\mathbf{150}_1$ over an entire length or substantial amount of the length (e.g., greater than 80%) of these body elements. Similarly, the second right-angled post $\mathbf{150}_2$ includes a slot 1120 extending between body elements of the post $\mathbf{150}_2$ over an entire length (or substantial amount thereof) of these body elements forming the second right-angled post $\mathbf{150}_2$.

Referring to FIG. 12, a vertical cross-sectional view of the framework 105 of the toy assembly system 100 along lines 12-12, illustrative of the covering materials $\mathbf{180}_1$ and $\mathbf{180}_2$ as installed surfaces for the toy assembly system 100 of FIG. 1, is shown. Herein, the second right-angled post $\mathbf{150}_2$ is coupled between two bases, such as the square base 110 and the second square base 165 for example. As shown, the second covering material $\mathbf{180}_2$ is positioned on a top surface 1200 of the second square base 165 and is secured between the ledge portion 1210 of the right-angled cap $\mathbf{170}_2$ and the top surface 1200 of the second square base 165. Similarly, the first covering material 1801 is positioned on a top surface of the square base 100 and, although not shown in the cross-sectional representation, is secured between a second traversing member of the right-angled post $\mathbf{150}_2$ and the top surface of the square base 110.

In the foregoing description, the invention is described with reference to specific exemplary embodiments thereof. For example, for certain connector pairs, the male and female connectors may be switched between neighboring components. For example, the accessory attachment element 160 may deploy a female connector while the head covering element 155 may deploy a male connector. It will, however, be evident that various modifications and changes may be made thereto without departing from the broader spirit and scope of the invention as set forth in the appended claims.

What is claimed is:

1. A modular toy assembly system, comprising:

a base; and a plurality of posts for coupling to the base, each post of the plurality of posts includes a first end connector and a second end connector with a first elongated body element and a second elongated body element interposed and extending between the first end connector and the second end connector, the first end connector of a first post of the plurality of posts includes a first protrusion extending from a top edge of the first elongated body element and a second protrusion extending from a top edge of the second elongated body element, where an orientation of the first protrusion is at an obtuse angle from an orientation of the second protrusion, wherein the first elongated body element and the second elongated body element are oriented to produce (i) a first slot between a first side of first elongated body element and a first side of the second elongated body element and (ii) a second slot between a second side of first elongated body element and a second side of the second elongated body element.

2. The modular toy assembly system of claim 1, wherein the first slot being sized with a width to receive and retain covering material, the covering material including a sheet of paper.

3. The modular toy assembly system of claim 1, wherein the first end connector of a first post of the plurality of posts includes a first protrusion extending from a top edge of the first elongated body element and a second protrusion extending from a top edge of the second elongated body element, where an orientation of the first protrusion is substantially in parallel to an orientation of the second protrusion.

4. The modular toy assembly system of claim 3, wherein the first protrusion includes a pair of protrusion segments arranged at a right angle to each other and the second protrusion includes a pair of protrusion segments arranged at a right angle to each other.

5. The modular toy assembly system of claim 4, wherein the first post further comprises a first traversing member extending between inner sidewalls of the top edge of the first elongated body element.

6. The modular toy assembly system of claim 4, wherein the first end connector further comprises a bridge member coupling the first protrusion at an area of intersection between the first protrusion segment and the second protrusion segment of the first protrusion to the second protrusion at an area of intersection between the first protrusion segment and the second protrusion segment of the second protrusion.

7. The modular toy assembly system of claim 1, wherein the base comprises a plurality of perimeter edge elements coupled end-to-end to form a polygon-shaped component with an opening in an interior area of the base, each perimeter edge element of the plurality of perimeter edge elements including a cut-out region having a lesser width than a width of a remaining region of the perimeter edge element.

8. The modular toy assembly system of claim 7, wherein an intersection area between neighboring perimeter edge elements of the plurality of perimeter edge elements includes a recessed connector having a cross-section suitable for insertion into and retention of the first end connector or the second end connector of a post of the plurality of posts.

9. The modular toy assembly system of claim 8 further comprising:

a cap including an angular border section and an interior section, the angular border section includes a pair of sidewalls arranged vertically and with a cross sectional shape for placement within a top opening of the recessed connector and the first end connector of the post being inserted and retained within a bottom opening of the recessed connector.

10. The modular toy assembly system of claim 9, wherein the interior section comprises a polygon-shaped ledge portion including (i) a first sidewall extending vertically from the ledge portion to form a first slot between the first sidewall and a first sidewall of the pair of sidewalls and (ii) a second sidewall extending vertically from the ledge portion to form a second slot between the second sidewall and a second sidewall of the pair of sidewalls.

11. The modular toy assembly system of claim 9, wherein the first slot of the cap includes a plurality of protrusions for retention of a covering material positioned within the first slot or the second slot.

12. The modular toy assembly system of claim 1, wherein the first protrusion comprises a first protrusion segment extending from a first portion of a top edge of the first elongated body and a second protrusion segment extending from a first portion of a top edge of the second elongated body and the second protrusion comprises a third protrusion segment extending from a second portion of the top edge of the first elongated body and a fourth protrusion segment extending from a second portion of the top edge of the second elongated body, wherein a side surface of the first protrusion segment is at an obtuse angle from a side surface of the third protrusion segment.

13. The modular toy assembly system of claim 12, wherein an edge of the first protrusion segment is coupled to an edge of the second protrusion segment, an edge of the third protrusion segment is coupled to an edge of the fourth protrusion segment, and an equidistant spacing is provided between the first protrusion segment and the third protrusion segment and the second protrusion segment and the fourth protrusion segment.

14. The modular toy assembly system of claim 1 further comprising:

a base fastener includes a pair of sidewalls to form a channel, a spacing between the pair of sidewalls is sized with a width to securely maintain a cut-out region of a perimeter edge element of a plurality of perimeter edge elements of the base flush against a cut-out region of a perimeter edge element of a second base, wherein the base fastener is to retain the perimeter edge element of the plurality of perimeter edge elements of the base in parallel with the perimeter edge element of the second base.

15. A modular toy assembly system, comprising:

a base including a plurality of perimeter edge elements coupled together in a polygon-shaped orientation, each perimeter edge element of the plurality of perimeter edge elements including a cut-out region having a lesser width than a width of a remaining region of the perimeter edge element and each intersection area between intersecting perimeter edge elements of the plurality of perimeter edge elements includes a recessed connector accessible from a top surface of the base and a bottom surface of the base;

a plurality of posts for coupling to the base, each post of the plurality of posts includes a first end connector and a second end connector with a first elongated body element and a second elongated body element interposed and extending between the first end connector and the second end connector, wherein the first end connector of at least a first post of the plurality of posts includes a first protrusion extending from a top edge of the first elongated body element and a second protrusion extending from a top edge of the second elongated body element, where an orientation of the first protrusion is at an obtuse angle from an orientation of the second protrusion.

16. The modular toy assembly system of claim 15, wherein the first end connector and the second end connector have a cross sectional area to insertion into and retention by the recessed connector of the base, and the first elongated body element and the second elongated body element are oriented to produce (i) a first slot between a first side of first elongated body element and a first side of the second elongated body element and (ii) a second slot between a second side of first elongated body element and a second side of the second elongated body element for retention of a covering material.

17. A modular toy assembly system, comprising:

a base including a plurality of perimeter edge elements coupled end-to-end to form a polygon-shaped component with an opening in an interior area of the base, each perimeter edge element of the plurality of perimeter edge elements including a cut-out region having a lesser width than a width of a remaining region of the perimeter edge element; and a plurality of posts for coupling to the base, each post of the plurality of posts includes a first end connector and a second end connector with a first elongated body element and a second elongated body element interposed and extending between the first end connector and the second end connector; and a cap including an angular border section and an interior section, the angular border section includes a pair of sidewalls arranged vertically, wherein an intersection area between neighboring perimeter edge elements of the plurality of perimeter edge elements includes a recessed connector having a cross-section suitable for insertion into and retention of the first end connector or the second end connector of a post of the plurality of posts and the cap including a cross sectional shape for placement within a top opening of the recessed connector and the first end connector of the post being inserted and retained within a bottom opening of the recessed connector.

18. The modular toy assembly system of claim 17, wherein the first elongated body element and the second elongated body element are oriented to produce (i) a first slot between a first side of first elongated body element and a first side of the second elongated body element and (ii) a second slot between a second side of first elongated body element and a second side of the second elongated body element.

* * * * *